US009816325B2

(12) United States Patent
Gadot et al.

(10) Patent No.: US 9,816,325 B2
(45) Date of Patent: Nov. 14, 2017

(54) ISOLATION ADAPTER FOR USING MULTIPLE POWER SOURCES IN A BOTTOM HOLE ASSEMBLY

(71) Applicant: Schlumberger Technology Corporation, Sugar Land, TX (US)

(72) Inventors: Raphael Gadot, Sugar Land, TX (US); Randall Leblanc, Katy, TX (US); Jason Gardner, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 828 days.

(21) Appl. No.: 14/254,818

(22) Filed: Apr. 16, 2014

(65) Prior Publication Data

US 2014/0311804 A1 Oct. 23, 2014

Related U.S. Application Data

(60) Provisional application No. 61/814,065, filed on Apr. 19, 2013.

(51) Int. Cl.
*E21B 17/00* (2006.01)
*E21B 47/00* (2012.01)

(52) U.S. Cl.
CPC ..... *E21B 17/003* (2013.01); *E21B 47/00* (2013.01)

(58) Field of Classification Search
CPC .. E21B 41/0085; E21B 17/028; E21B 17/023; E21B 17/003; E21B 47/00; G01V 11/002
USPC ..... 307/38; 710/110
See application file for complete search history.

(56) References Cited

U.S. PATENT DOCUMENTS 9,206,672 B2 * 12/2015 Cooley ..... E21B 41/0085
2009/0194332 A1 * 8/2009 Pastusek ..... E21B 21/08 175/40
2010/0300677 A1 * 12/2010 Patterson, III ..... E21B 17/028 166/65.1
2012/0146415 A1 * 6/2012 Simsek ..... H02J 3/14 307/38
2012/0268074 A1 * 10/2012 Cooley ..... H01G 11/58 320/130
2014/0083770 A1 * 3/2014 Codazzi ..... E21B 47/12 175/40
2014/0169127 A1 * 6/2014 Orban ..... G01V 1/40 367/25
2015/0047836 A1 * 2/2015 Mitchell ..... E21B 47/02216 166/254.1

* cited by examiner

*Primary Examiner* — Michael Wills, III

(57) ABSTRACT

The present disclosure relates to a power isolation adapter which can enable the use of multiple power sources in a bottom hole assembly (BHA) by isolating the power sources on a tool bus while maintaining a communication bus across the BHA. Such power sources may be part of a measurement-while-drilling (MWD) module, such as a mud turbine generator, providing power as a DC signal. The power isolation adapter isolates the power sources by blocking DC signals, but maintains an AC communication bus across the BHA. The ability to use multiple power sources in a BHA thus allows for more complex BHA configurations that normally could not be powered using a single power source.

15 Claims, 6 Drawing Sheets

ISOLATION ADAPTER FOR USING MULTIPLE POWER SOURCES IN A BOTTOM HOLE ASSEMBLY

CROSS REFERENCE TO RELATED APPLICATION

This application claims priority to and the benefit of U.S. Provisional Application Ser. No. 61/814,065 entitled "ISOLATION ADAPTER FOR USING MULTIPLE POWER SOURCES IN A BOTTOM HOLE ASSEMBLY", filed Apr. 19, 2013, the disclosure of which is hereby incorporated by reference in its entirety.

BACKGROUND

This section is intended to introduce the reader to various aspects of art that may be related to various aspects of the subject matter described and/or claimed below. This discussion is believed to be helpful in providing the reader with background information to facilitate a better understanding of the various aspects of the present disclosure. Accordingly, it should be understood that these statements are to be read in this light, not as admissions of prior art.

The present disclosure relates generally to making measurements of subsurface formations surrounding a wellbore using one or more downhole tools of a bottom hole assembly (BHA) that is integral to a drill string and, more particularly, to the electrical power and communication buses between the downhole tools making up the BHA.

Logging tools have long been used in wellbores to make, for example, formation evaluation measurements to infer properties of the subsurface formations surrounding the borehole and the fluids in such formations. Examples of common logging tools include electromagnetic tools, nuclear tools, and nuclear magnetic resonance (NMR) tools. Aside from these examples, various other tool types may also be used for evaluation of subsurface formation properties, such as acoustic logging tools.

Early logging tools were typically run into a wellbore using a wireline cable after the wellbore had been drilled. Modern versions of such wireline tools are still used extensively today. However, the desire for information while drilling the borehole gave rise to the development of measurement-while-drilling (MWD) tools and logging-while-drilling (LWD) tools. MWD tools typically provide drilling parameter information, such as weight on the bit, torque, temperature, pressure, direction, and inclination. LWD tools typically provide formation evaluation measurements such as resistivity, porosity, and NMR distributions (e.g., T1 and T2 relaxation times). MWD and LWD tools often have components common to wireline tools (e.g., transmitting and receiving antennas). However, MWD and LWD tools are also designed and constructed to endure the harsh environment of drilling.

A BHA typically includes a single MWD tool and several LWD tools that are connected by a low power tool bus (referred to as "LTB" or "LTB bus"). The LTB bus provides power to the logging tools and also provides a communication link by which the tools can communicate with one another. For example, the source of this power can be a turbine generator in the MWD tool that is driven by pressurized drilling fluid ("mud") when mud pumps are on. However, the turbine generator of an MWD has limitations on the amount of power it can provide, thus restricting the possible configurations of a BHA, or at the very least limiting the number of tools in a BHA that can be operated simultaneously. As the industry continues to explore and drill to greater depths (e.g., depths of 20,000 feet or more) in the search of producible subsurface hydrocarbon formations, BHAs have continued to increase in complexity such that existing MWD modules may have difficulty supplying sufficient power for an entire BHA.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with aspects of the present disclosure, a power isolation adapter is provided to enable the use of multiple power sources in a bottom hole assembly (BHA) by isolating the power sources on a tool bus, while maintaining a communication bus across the BHA. In certain embodiments, the power sources are part of a measurement-while-drilling (MWD) module, such as a mud turbine generator, and provide power as a DC signal. The power isolation adapter isolates the power sources by blocking DC signals between separately powered logging-while-drilling (LWD) tools or sets of LWD tools in the BHA, while maintaining an AC communication bus across the LWD tools of the BHA. The ability to use multiple power sources in a BHA thus allows for more complex BHA configurations that normally could not be powered using a single power source.

In accordance with one aspect of the disclosure, a bottom hole assembly (BHA) system includes a first set of downhole tools having a first power source that powers each of the tools of the first set, and a second set of downhole tools having a second power source that powers each of the tools of the second set. The BHA further includes an isolation adapter electronically coupled to the first set of downhole tools and the second set of downhole tools, wherein the isolation adapter isolates first and second power sources and maintains a communication bus across the first and second sets of downhole tools.

In accordance with another aspect of the disclosure, a system includes a circuit having a first input terminal that electrically couples the circuit to a bus for power and communication signals and a second input terminal that electrically couples the circuit to the bus for power and communication signals. The circuit also includes a first capacitor electrically coupled to the first input terminal, wherein the first capacitor impedes a power signal from the first input terminal and passes a communication signal from the first input terminal, as well as a second capacitor electrically coupled to the second input terminal, wherein the second capacitor impedes a power signal from the second input terminal and passes a communication signal from the second input terminal. Additionally, the circuit includes a transformer arranged between the first and second capacitors to provide impedance matching between the first and second input terminals.

In accordance with a further aspect of this disclosure, a method includes providing a bottom hole assembly including a first set of downhole tools having a first power source and a second set of downhole tools having a second power source and coupling the first set of downhole tools to the second set of downhole tools using an isolation adapter that isolates first and second power sources and maintains a communication bus across the first and second sets of downhole tools.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure are described below. These embodiments are only examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features.

As will be discussed below, aspects of the present disclosure relate to a power isolation adapter which can enable the use of multiple power sources in a bottom hole assembly (BHA) by isolating the power sources on a tool bus, while maintaining a communication bus across the BHA. In certain embodiments, the power sources are part of a measurement-while-drilling (MWD) module, such as a mud turbine generator, and provide power as a DC signal. The power isolation adapter isolates the power sources by blocking DC signals between separately powered logging-while-drilling (LWD) tools or sets of LWD tools in the BHA, while maintaining an AC communication bus across the LWD tools of the BHA. The ability to use multiple power sources in a BHA thus allows for more complex BHA configurations that normally could not be powered using a single power source.

Figure 1:
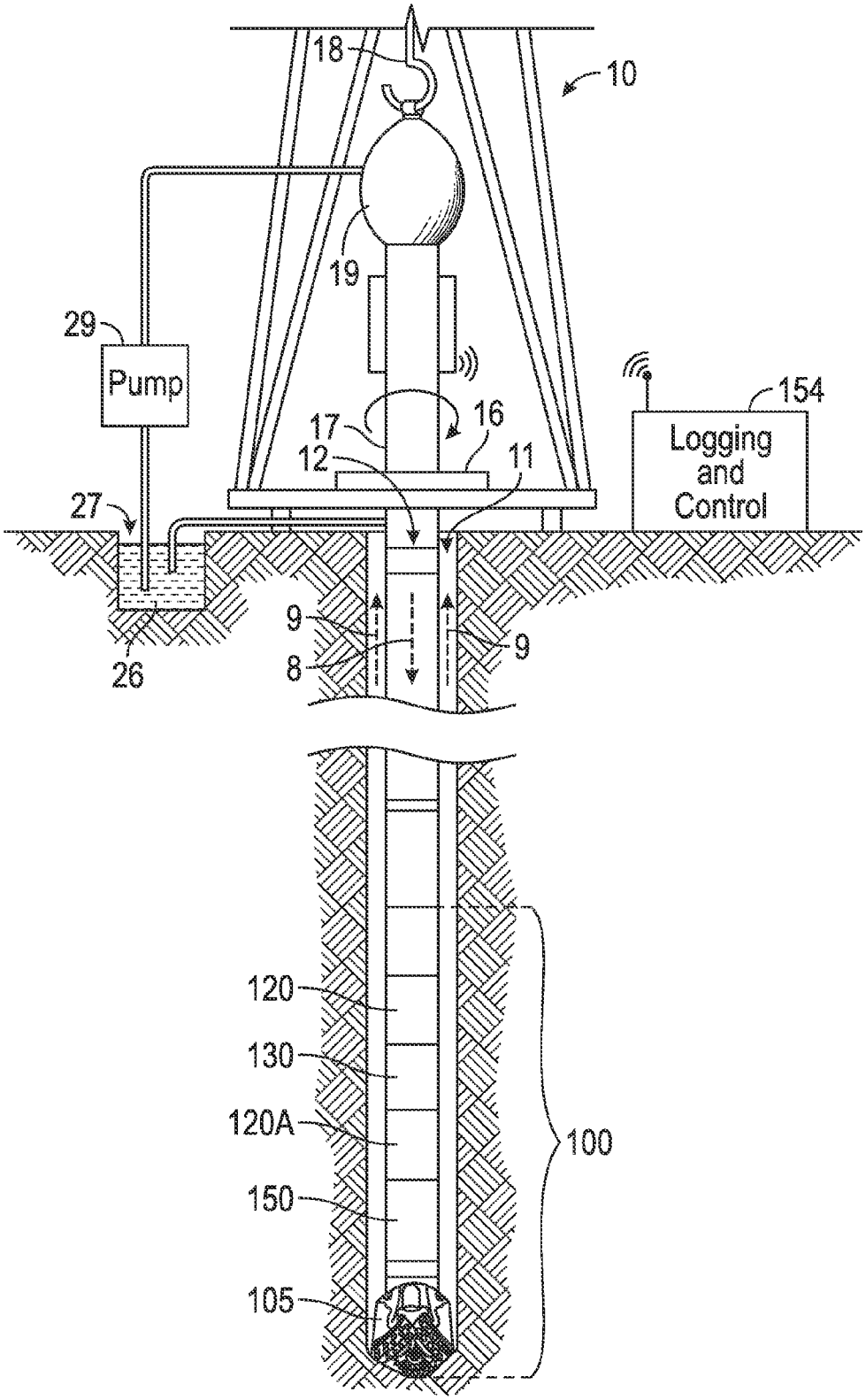
FIG. 1 is a schematic diagram of a subterranean well logging system that includes a bottom hole assembly (BHA) having a measurement-while-drilling (MWD) module that powers one or more logging-while-drilling (LWD) modules.

FIG. 1 represents a simplified view of a well site system in which various embodiments can be employed. The presently illustrated well site system is shown as having a conventional BHA with a single measurement-while-drilling (MWD) module powering one or more LWD tools. However, as will be discussed with reference to the additional figures provided in this disclosure, BHAs that include multiple MWD modules coupled via a power isolation adapter (or simply referred to as "isolation adapter") in accordance with embodiments of the present disclosure may also be used in conjunction with such well site systems. In such embodiments, each MWD module may be configured to power respective LWD tools or respective sets of LWD tools.

As will be appreciated, the well site system depicted in FIG. 1 can be deployed in either onshore or offshore applications. In this type of system, a borehole 11 is formed in subsurface formations by rotary drilling in a manner that is well known to those skilled in the art. Some embodiments can also use directional drilling. A drill string 12 is suspended within the borehole 11 and has a BHA 100 which includes a drill bit 105 at its lower end. The surface system includes platform and derrick assembly 10 positioned over the borehole 11, with the assembly 10 including a rotary table 16, kelly 17, hook 18 and rotary swivel 19. The drill string 12 is rotated by the rotary table 16 (energized by means not shown), which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In this example embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this known manner, the drilling fluid lubricates the drill bit 105 and carries formation cuttings up to the surface as it is returned to the pit 27 for recirculation.

The drill string 12 includes a BHA 100. In the illustrated embodiment, the BHA 100 is shown as having one MWD module 130 and multiple LWD modules 120 (with reference number 120A depicting a second LWD module 120). As used herein, the term "module" as applied to MWD and LWD devices is understood to mean either a single tool or multiple tools contained in a single modular device. Additionally, the BHA 100 includes a rotary steerable system (RSS) and motor 150 and a drill bit 105.

The LWD modules 120 may be housed in a drill collar, as is known in the art, and can include one or more types of logging tools. As can be appreciated, the LWD modules 120 may include capabilities for measuring, processing, and storing information, as well as for communicating with the surface equipment. By way of example only, the LWD module 120 may include at least one of a resistivity, neutron and/or gamma-ray, nuclear, nuclear magnetic resonance (NMR), or acoustic logging tool, or a combination of such logging tools.

The MWD module 130 is also housed in a drill collar, as is known in the art, and can contain one or more devices for measuring characteristics of the drill string and drill bit. The MWD tool 130 further includes an apparatus (not shown) for generating electrical power for the downhole system. This may typically include a mud turbine generator powered by the flow of the drilling fluid. It is understood, however, that other power and/or battery systems may be employed.

As discussed above, conventional BHAs, such as the BHA 100 shown in FIG. 1, often include a single MWD tool that provides power to and a communication link between several LWD tools. Accordingly, the LWD tools 120 are able to communicate with one another and with the MWD 130 by way of the communication link while also receiving electrical power for operation from the MWD 130 via a power bus. In certain embodiments, the power bus and communication link may be provided as a low power single wire interface, where power is provided as a direct current (DC) signal and data is transmitted using an alternating current (AC) signal to provide inter-tool communications. This is sometimes referred to as a low-power tool bus, or "LTB" or "LTB bus." An LTB bus may provide both power and communication buses while utilizing the drill collar mass as the return current path. In other embodiments, power and data may be transmitted via different respective wire interfaces. Additional details regarding the inter-tool power and communications bus topology will be discussed further below with reference to FIGS. 2 and 3.

In the present embodiment, the MWD module 130 can include one or more of the following types of measuring devices: a weight-on-bit measuring device, a torque measuring device, a vibration measuring device, a shock measuring device, a stick/slip measuring device, a direction measuring device, and an inclination measuring device (the latter two sometimes being referred to collectively as a D&I package).

The operation of the assembly 10 of FIG. 1 may be controlled using the logging and control system 154, which may include one or more processor-based computing systems. In the present context, a processor may include a microprocessor, programmable logic devices (PLDs), field-gate programmable arrays (FPGAs), application-specific integrated circuits (ASICs), system-on-a-chip processors (SoCs), or any other suitable integrated circuit capable of executing encoded instructions stored, for example, on tangible computer-readable media (e.g., read-only memory, random access memory, a hard drive, optical disk, flash memory, etc.). Such instructions may correspond to, for instance, workflows and the like for carrying out a drilling operation, algorithms and routines for performing various inversions using acquired logging data (e.g., for determining formation models), and so forth.

Figure 2:
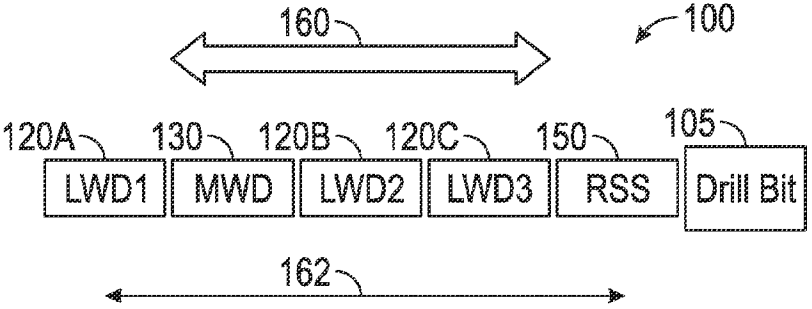
FIG. 2 shows an example of a BHA configuration having a single power source.

FIG. 2 shows one possible configuration of the BHA 100 of FIG. 1 in more detail. In this illustrated example, the BHA 100 includes the MWD module 130 and three LWD modules labeled as 120A-120C. The MWD module 130 and the LWD modules 120 may be coupled in a way that provides a communication bus 160 and a power bus 162. As discussed above, in one embodiment, the communication bus 160 and power bus 162 may be provided by a common single wire bus, i.e., LTB bus. In this configuration, power is provided to the LWD modules 120A-120C by the MWD module 130 via a DC signal transmitted along the LTB bus, and LWD modules 120A-120C may also communicate with each other and with the MWD module 130 via AC data signals transmitted via the communication bus 160.

Figure 3:
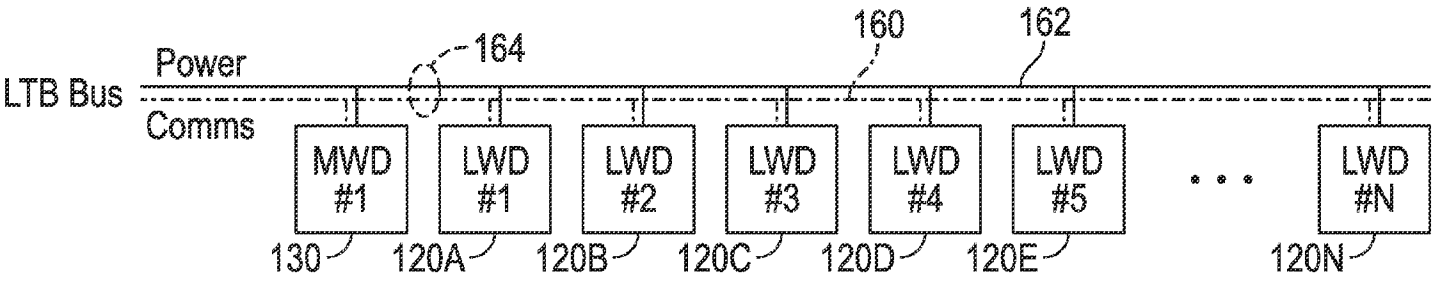
FIG. 3 shows the power and communication bus topology that corresponds to the BHA configuration of FIG. 2.

FIG. 3 shows the bus topology of an LTB bus 164 established between an MWD module 130 and multiple LWD modules "LWD#1" to "LWD#N" (labeled using reference numbers 120A-120N, respectively). As shown, the MWD module 130 and each LWD module 120A-120N are part of a power bus 162 and a communication bus 160. In this manner, the MWD module 130 can supply electrical power (e.g., power generated by a downhole mud turbine or any other suitable power generation device) to each of the LWD modules 120A-120N as a DC signal via the power bus 162. Further, the LWD modules 120A-120N and the MWD module 130 may communicate (e.g., send/receive data to any other module on the LTB bus) with each other via transmitting or receiving data in the form of an AC signal transmitted along the communication bus 160 of the LTB bus 164. Though shown illustratively as separate buses for clarity, it is understood (as discussed above) that the LTB bus 164 may provide both the illustrated communication bus 160 and power bus 162 using a single-wire bus interface. In other words, data and power may be transmitted using the same physical bus, but as different types of electrical signals (AC signal vs. DC signal). Of course, in other embodiments, different bus protocols may be used, including those where power and communications are provided using physically separate bus interfaces.

In a conventional BHA that includes a single MWD module 130 having a power generation device (such as the BHA 100 shown in FIGS. 1 through 3), it is understood that the power generation device (e.g., a mud turbine) has limitations on the amount of power it is capable of providing. As explained in the Background Section, above, this limits the configuration of a BHA. For instance, since each LWD module that is included as part of the BHA will likely use some amount of electrical power for operation, the power limitations of a single MWD module may restrict the number of LWD modules that can be powered simultaneously. Thus, from a configuration standpoint, the power limitations of an MWD module often restricts the possible configurations of a BHA, i.e., the number/type of LWD modules that can be included in the BHA or at very least the number of LWD modules that can be operated simultaneously in the BHA. Nonetheless, as the desire to drill to deeper depths (e.g., 20,000 feet or greater) continues to increase, the complexity of BHAs continues to increase as well. Accordingly, downhole power requirements have, in some cases, grown to a level to which current available power sources can be insufficient depending on the complexity of the BHA.

Figure 4:
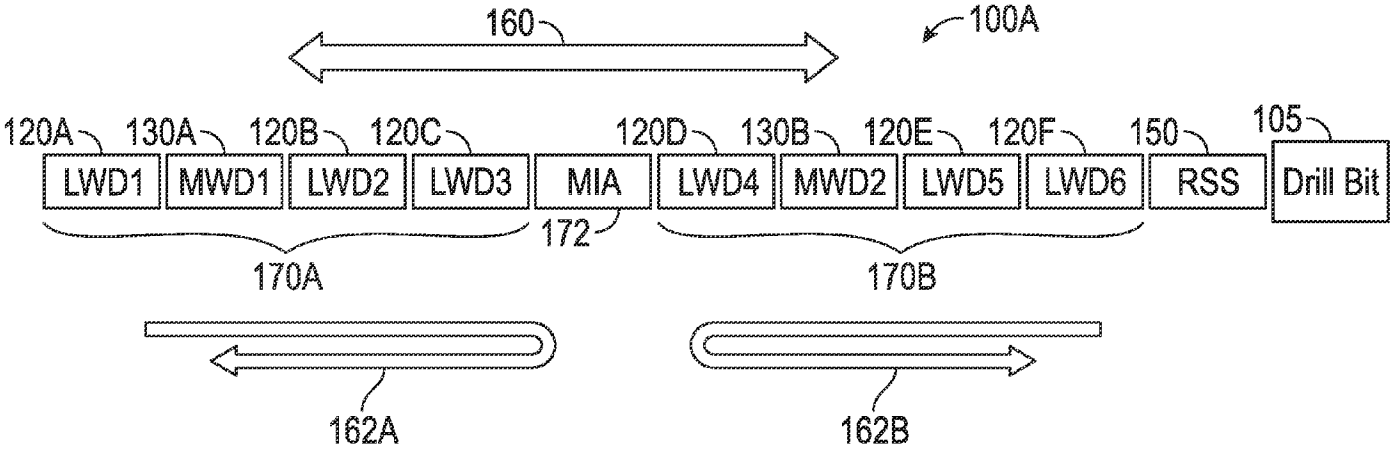
FIG. 4 shows an example of a BHA configuration having multiple power sources that are isolated using a power isolation adapter in accordance with an embodiment of the present disclosure.

An isolation adapter apparatus in accordance with embodiments of the present disclosure may allow for two or more power sources to be used in a BHA. The adapter is configured to isolate the power sources while still allowing for a communication bus to extend between the tools or sets of tools in the BHA powered by the respective power sources. Referring now to FIG. 4, a possible configuration of a BHA (referred to using reference number 100A) that includes multiple MWD modules 130A and 130B that power separate respective sets of tools is illustrated in accordance with an embodiment of the present disclosure. For example, the set of downhole tools 170A includes the MWD module 130A and LWD modules 120A, 120B and 120C, and the set of downhole tools 170B includes the MWD module 130B and LWD modules 120D, 120E, and 120F.

A power isolation adapter 172 (labeled as MIA for "MWD isolation adapter" in FIG. 4) electronically couples the tool sets 170A and 170B in a manner such that their respective power sources, i.e., provided by MWD modules 130A and 130B, are isolated. This is shown by the isolated power buses 162A and 162B for the tool sets 170A and 170B, respectively. Further, at the same time, the adapter 172 allows communication signals to pass between the tool sets 170A and 170B, as represented by the communication bus 160 that extends through the isolation adapter 172 and across the tool sets 170A and 170B of the BHA 100A. Thus, in the present example, the power source (e.g., mud turbine) of MWD module 130A powers LWD modules 120A-120C but is isolated from MWD module 130B and its respective power source. Similarly, the power source of MWD module 130B powers LWD modules 120D-120F but is isolated from MWD module 130A and its respective power source. However, as the communication bus 160 extends across the both tool sets 170A and 170B of the BHA (including through the adapter 172), any tool in the BHA 100A is capable of communicating with any other tool in the tool sets 170A and 170B. The BHA 100A may be used with the well site system of FIG. 1 as part of the drill string 12. In some embodiments, the RSS 150 may also be powered by the LTB bus (power bus 162B in this example). In other embodiments, the RSS 150 may include its own power generator (e.g., another mud turbine generator).

Assuming in this example that an LTB bus is provided (e.g., where the power buses 162A and 162B are DC and the communication bus 160 is AC), the adapter 172 of this embodiment provides the function of blocking DC signals while allowing AC signals to pass through. An example of circuitry that may be used to accomplish this functionality is discussed further below. Moreover, as both MWD modules 130A and 130B are capable of operating as master devices on the bus, arbitration techniques may be implemented to prevent both MWD devices from driving the bus simultaneously. Examples of such techniques are also described further below.

Figure 5:
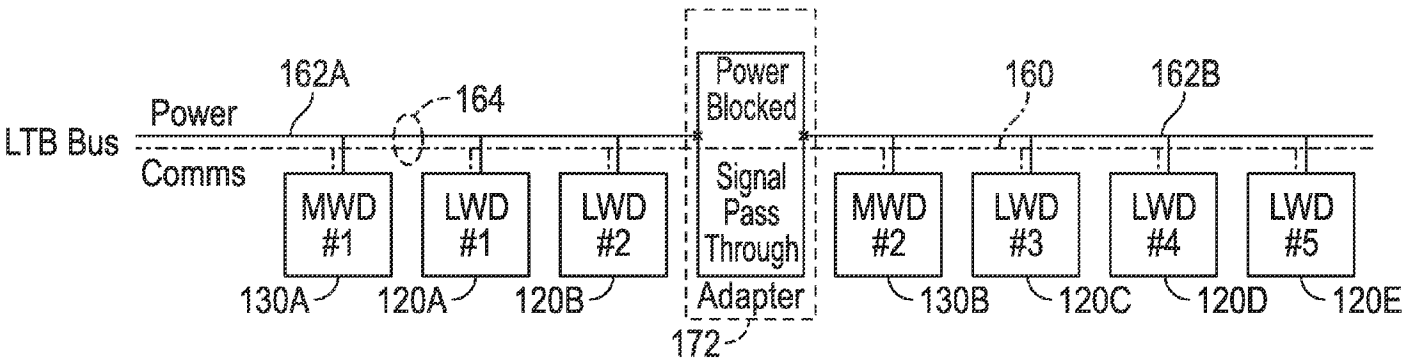
FIG. 5 shows the power and communication bus topology that corresponds to the BHA configuration of FIG. 4.

FIG. 5 shows the bus topology of an LTB bus 164 established in a BHA having multiple MWD modules 130A and 130B. It can be seen here that the communication bus 160 extends across both MWD modules 130A and 130B and their respective LWD modules, thus allowing for data to be exchanged between any of the tools on the LTB bus 164 using AC data signals. Further, it can be seen that the power bus is isolated between the MWD modules 130A and 130B by the adapter 172, thus forming separate power busses 162A (powers LWD modules 120A and 120B) and 162B (powers LWD modules 120C, 120D, and 120E). Again, it is understood that though shown as separate lines for illustrative purposes in FIG. 5, the LTB bus 164 is a single wire bus that extends across the BHA, except that in this example, DC power signals are not transmitted though through the adapter 172.

Figure 6:
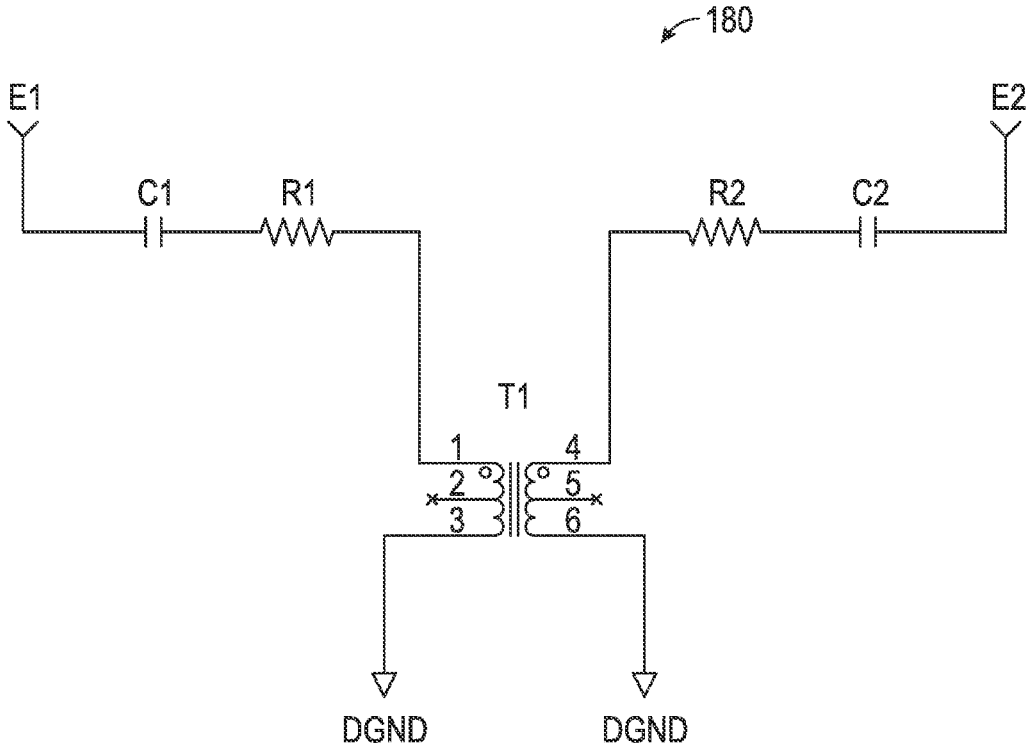
FIG. 6 is a circuit diagram depicting electronic circuitry that isolates DC power sources while passing AC communication signals in accordance with an embodiment of the present disclosure.

FIG. 6 is a simplified circuit diagram that illustrates circuitry 180 of the isolation adapter 172. As shown, the circuit includes input terminals E1 and E2, each of which may couple to an LWD module or MWD module when the adapter 172 is incorporated into a BHA, such as BHA 100A of FIG. 4. For instance, referring to FIG. 4 as an example, the terminal E1 may be coupled to LWD module 120C and the terminal E2 may be coupled to LWD module 120D. Thus, the adapter 172 is coupled in series between two modules in the BHA, and the circuitry between the input terminals E1 and E2 is thus part of the LTB bus 164. As will be known by those skilled in the art, the adapter 172 may be coupled directly to an LWD or MWD module, or indirectly by way of an extender.

The circuit 180 includes transformer T1 and capacitors C1 and C2. The arrangement of the transformer T1 and the two capacitors C1 and C2 (for symmetry) is the basis for the adapter's 172 ability to block DC power signals and couple AC communication signals from each of the tool segments (e.g., 170A, 170B in FIG. 4) while also maintaining a matching impedance. The capacitors C1 and C2 function to block DC signals seen at each input terminal E1 and E2 and allowing AC signals to pass, while the transformer T1 provides impedance matching functionality. This is due to the tendency of capacitors to oppose changes in voltage (either by drawing in or supplying current as they charge and discharge). The flow of current through a capacitor is, therefore, directly proportional to the rate of change of voltage across it. Thus, as DC signals have a generally constant voltage, DC currents are blocked by capacitors. Since AC signals have voltages that change in a regular manner (e.g., a sinusoidal function), the rate of change in voltage is non-zero and hence AC currents are not blocked by capacitors.

By way of example only, in one embodiment, the transformer T1 may have dimension of approximately 0.5 by 0.6 inches, and the capacitors C1 and C2 may each have a capacitance of between approximately 0.1 to 0.5 μF (e.g., 0.22 μF in one particular embodiment). The transformer T1 may have primary and secondary windings that provide a "perfect" or a near-perfect transformer (e.g., a substantially 1:1 ratio). The terminals DGND represent internal grounding points. Further, in the circuit 180 of FIG. 6, resistor R1 is coupled between capacitor C1 and transformer T1 and resistor R2 is coupled between capacitor C2 and transformer T1. In this example, the resistors R1 and R2 may each have a resistance of approximately 5 ohms and are provided here for fault tolerance testing purposes. Thus, the resistors R1 and R2 are not required for the above-described function provided by the adapter 172, and may be omitted.

The circuitry 180 in FIG. 6 is particularly well-suited for an embodiment that uses a single wire bus for both communication and power signals, such as an LTB bus. However, it should be understood that other embodiments may carry power and communication signals on separate physical buses. For instance, assuming a different type of bus interface where a first physical bus is provided for AC communication and data signals and a second physical bus (separate from the first bus) is provided for DC power signals, the isolation adapter 172 may provide the same functionality when using multiple power sources in a BHA, but may have a different circuit configuration. For instance, in this example, the circuitry of the isolation adapter 172 may include a single capacitor for blocking the DC signals between the power sources, while including a separate wire interface (basically a short circuit) that allows AC communication signals to pass through the adapter 172.

Figure 7:
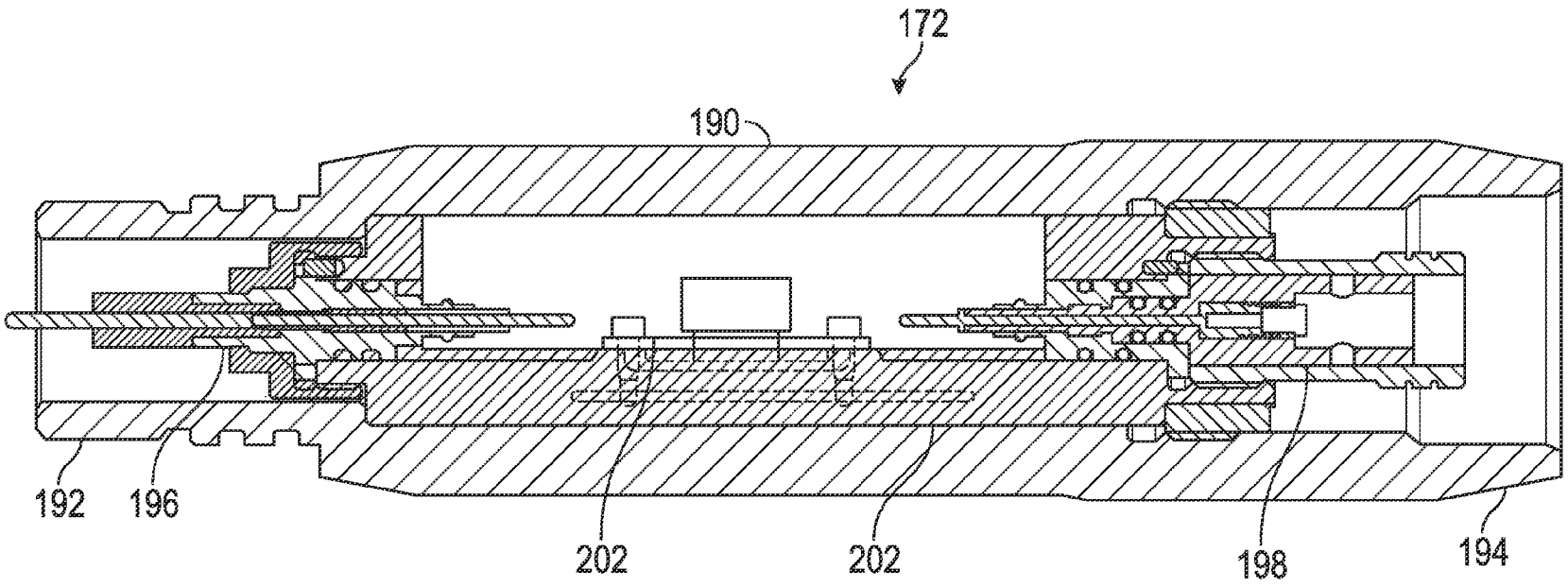
FIG. 7 is a cross-sectional cut-away view showing an embodiment of a power isolation adapter.

FIG. 7 is a cross-sectional cut-away view of an isolation adapter 172 in accordance with one embodiment of the present disclosure. The adapter 172 includes a housing 190, which may have openings 192 and 194 on opposite ends thereof that expose connectors 196 and 198, respectively. The connectors 196 and 198 enable the adapter 172 to connect to tools within the BHA (e.g., MWD or LWD modules). A cartridge 200 is disposed within the housing 190 and may secure an electrical circuit board 202 on which the circuitry 180 (FIG. 6) is contained. As will be appreciated, like LWD and MWD tools, the isolation adapter 172 may be designed to withstand conditions typically encountered in wellbores and particularly during the drilling of wellbores. For instance, the adapter 172 may be rated to withstand temperatures of up to 175 degrees centigrade and pressures as high as 32 kpsi. Further, the adapter 172 may also be designed to protect the cartridge from mud invasion.

Figure 8:
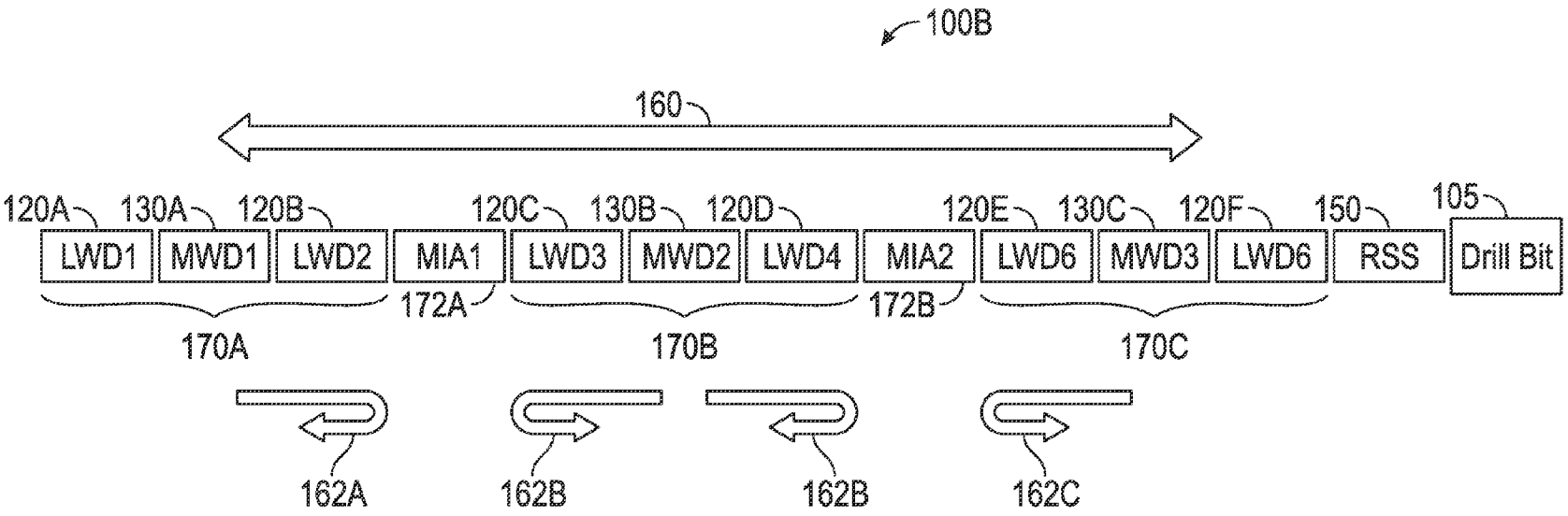
FIG. 8 shows an example of a BHA configuration having multiple power sources that are isolated using multiple power isolation adapters in accordance with a further embodiment of the present disclosure.

While the examples above have shown the use of the power isolation adapter described herein to allow for two power sources to be used in a BHA, it will be appreciated that multiple adapters of this type may be used to enable greater than two power sources to be used in a BHA. For example, a possible configuration of a three-MWD BHA, referred to by reference number 100B, is shown in FIG. 8. This example is similar to the dual-MWD example of FIG. 4, where a first tool set 170A and second tool set 170B are coupled via isolation adapter 172A which isolates the power buses 162A and 162B. However, in FIG. 8, an additional adapter 172B is provided to couple the tool set 170B to a third tool set 170C containing another MWD module 130C having a power generation device. As can be seen, the power bus 162C of the third tool set 170C is isolated from the power bus 162B of the second tool set 170B. However, the adapters 172A and 172B allow for the communication bus 160 to extend across the all the tool sets (170A-170C) of the BHA 100B.

As can be appreciated, the ability to use multiple MWD modules in a BHA using the techniques described above may allow for a greater amount of power to be used downhole. This potentially allows for more complex BHA configurations, i.e., with more tools and measurement/logging capabilities. However, when multiple MWD modules that have the capability to function as master devices on a bus (e.g., LTB bus) are present in the BHA, it may be useful to provide arbitration configuration options to, for example, prevent multiple MWD modules from driving the bus simultaneously.

In a typical bus architecture, a master device (e.g., an MWD tool) typically controls the slave devices (e.g., LWD tools) on the bus, and slave devices typically do not initiate communication. As an example, a bus master may specify which slave device should operate by placing an address (e.g., a tool identifier) in the header of a communication packet. The slave devices then parse the incoming communication packet and reply or take action (e.g., in response to the communication) if the specified address matches their own. While a slave device may gain mastership of the bus from time to time (typically for a specific amount of time only), such permissions are typically granted by the master device in response to a request by the slave device.

Examples of arbitration techniques that may be used in a BHA having two or more MWD devices capable of operating as master devices are now described below using the configuration of BHA 100A in FIG. 4 as an example. As shown, in this example configuration, MWD1 powers LWD1, LWD2, and LWD3 while MWD2 powers LW4, LWD5, and LWD6. Here, either MWD1 or MWD2 may be configured as a master device for communications throughout the BHA, while the other remaining MWD module is configured as a slave or a dormant device. As an example, the MWD modules 130 shown in FIG. 4 may provide electrical power (e.g., via a mud turbine), telemetry functionality (e.g., using mud pulse telemetry with data modulation), a direction & inclination package, azimuth sensor, and gamma ray measurement capabilities in a single module. By way of example only, the MWD modules 130 in FIG. 4 may be a model of TELESCOPE, an MWD tool available from Schlumberger Technology Corporation, Sugar Land, Tex.

In one possible configuration, MWD1 may be configured as a primary MWD module (having bus mastership) while MWD2 is configured as a secondary MWD module that operates in a dormant communication mode. In this configuration, MWD1 powers LWD1-LWD3, but may acquire data from each of the LWD tools in the BHA (LWD1-LWD6), while MWD2 functions solely to provide power to its respective LWD modules (LWD4-LWD6). Advantages of this configuration are that MWD2 will not interfere with bus communications or accidentally enter into a dual master role. However, under this configuration mode, MWD2 cannot be utilized in a redundant manner if, for example, MWD1 fails. Additionally, there is no slave mode in this configuration, as data from MWD2 data cannot be collected by MWD1 for transmission in a deep well signal modulator scheme.

In a second configuration, MWD1 acts as a master (primary) and powers LWD1-LWD3 but may acquire data from each of the LWD tools (LWD1-LWD6). MWD2 acts as a permanent slave device (secondary) on the bus and provides power to its respective LWD modules (LWD4-LWD6). Data from MWD2 can also be acquired by MWD1 along the communication bus 160. In this configuration, MWD2's modulator can be enabled or disabled to transmit internal data from MWD2 at an alternate frequency. Advantages of this configuration are that data from MWD2 can be sent by MWD1 (e.g., telemetered up hole) in deeper wells where two telemetry frequencies cannot be used. Additionally, in this configuration, there is no accidental dual master mode. However, like the dormant mode configuration discussed above, this "permanent slave" configuration does not take advantage of redundancy.

A third configuration mode may be referred as a handshaking mode. In this mode, MWD1 may be configured as a default primary master. Here, MWD1 powers LWD1-LWD3 and may acquire data from LWD tools (LWD1-LWD6), while the secondary MWD (MWD2) provides power and acts as a slave device such that its data can be acquired by MWD1. Further, this handshaking configuration may utilize a ping system, where MWD2 becomes the master in the event that MWD1 fails. Thus, this configuration provides the additional advantage of system redundancy.

Accordingly, the use of an isolation adapter in accordance with the present disclosure allows for inter-BHA communications while isolating multiple power sources in BHA's that require more power than a single power source can provide. These techniques may allow greater real time bandwidth to be used at shallower depths where two or more MWD tools with modulators can be used in the same BHA/drill string. Further, at greater depths (where telemetry of data is done over greater distances), improved demodulation can be achieved by allowing the modulator on one MWD tool to be disabled and using the modulator on the remaining MWD tool to transmit the entirety of the BHA's data at a more manageable telemetry frequency. Additionally, though discussed specifically with application to MWD modules, it should be understood that the isolation adapter of the present disclosure could be used to isolate any type of DC power sources, such as a battery-based power source.

As will be understood, the various techniques described above and relating to the use of multiple power sources in a BHA are provided herein by way of example only. Accordingly, it should be understood that the present disclosure should not be construed as being limited to only the examples provided above. Further, it should be appreciated that the various arbitration schemes discussed above may be implemented in any suitable manner, including hardware (suitably configured circuitry), software (e.g., via a computer program including executable code stored on one or more tangible computer readable medium), or via using a combination of both hardware and software elements.

While the specific embodiments described above have been shown by way of example, it will be appreciated that many modifications and other embodiments will come to the mind of one skilled in the art having the benefit of the teachings presented in the foregoing description and the associated drawings. Accordingly, it is understood that various modifications and embodiments are intended to be included within the scope of the appended claims.

What is claimed is:

1. A bottom hole assembly (BHA) system comprising:

a first set of downhole tools comprising a first power source that powers each of the tools of the first set;

a second set of downhole tools comprising a second power source that powers each of the tools of the second set; and an isolation adapter electronically coupled to the first set of downhole tools and the second set of downhole tools, wherein the isolation adapter isolates first and second power sources and maintains a communication bus across the first and second sets of downhole tools, wherein the first and second power sources provide DC power via a power bus, and wherein the communication bus transmits data using AC signals.

2. The system of claim 1, wherein the first power source and the second power source are part of a measurement-while-drilling (MWD) tool.

3. The system of claim 2, wherein the first power source or the second power source comprise a mud turbine.

4. The system of claim 1, wherein the downhole tools of the first set and the downhole tools of the second set comprise logging-while-drilling (LWD) tools.

5. The system of claim 4, wherein the LWD tools comprise at least one of a resistivity, nuclear magnetic resonance (NMR), gamma-ray, nuclear, or acoustic logging tool.

6. The system of claim 1, wherein the power bus and the communication bus are established using a common single wire bus interface.

7. The system of claim 1, wherein the isolation adapter comprises an electronic circuit having:

a first input terminal coupled to the first set of downhole tools;

a second input terminal coupled to the second set of downhole tools;

a transformer;

a first capacitor arranged between the first input terminal and the transformer; and a second capacitor arranged between the second input terminal and the transformer;

wherein the first capacitor blocks a DC signal received at the first input terminal and the second capacitor blocks a DC signal received at the second input terminal.

8. The system of claim 7, wherein the transformer has a primary winding and a secondary winding that provides a ratio of substantially 1:1.

9. A system comprising:

a circuit having:

a first input terminal that electrically couples the circuit to a bus for power and communication signals;

a second input terminal that electrically couples the circuit to the bus for power and communication signals;

a first capacitor electrically coupled to the first input terminal, wherein the first capacitor impedes a power signal from the first input terminal and passes a communication signal from the first input terminal;

a second capacitor electrically coupled to the second input terminal, wherein the second capacitor impedes a power signal from the second input terminal and passes a communication signal from the second input terminal; and a transformer arranged between the first and second capacitors to provide impedance matching between the first and second input terminals.

10. The system of claim 9, wherein the power signals from the first and second input terminal comprise DC signals, and wherein the communication signals from the first and second input terminals comprise AC signals.

11. The system of claim 9, wherein the first input terminal is coupled to a first group of logging tools of a drilling system bottom hole assembly (BHA) and the second input terminal is coupled to a second group of logging tools of the drilling system BHA.

12. The system of claim 11, wherein the first group of logging tools is powered by at least one measurement-while-drilling (MWD) tool having a power source and the second group of logging tools is powered by at least one additional measurement-while-drilling (MWD) tool having a power source.

13. The system of claim 12, wherein each of the power sources comprise a mud turbine generator.

14. A method comprising:

providing a bottom hole assembly including a first set of downhole tools having a first power source and a second set of downhole tools having a second power source; and coupling the first set of downhole tools to the second set of downhole tools using an isolation adapter that isolates first and second power sources and maintains a communication bus across the first and second sets of downhole tools, wherein the first and second power sources provide DC power via a power bus, and wherein the communication bus transmits data using AC signals.

15. The method of claim 14, wherein the power bus and the communication bus are established using a common single wire bus interface.

* * * * *